United States Patent [19]

Nagle

[11] Patent Number: 4,637,835

[45] Date of Patent: Jan. 20, 1987

[54] METHODS OF HYDROLYZING CELLULOSE TO GLUCOSE AND OTHER (POLY)SACCHARIDES

[75] Inventor: Richard T. Nagle, Upper Montclaire, N.J.

[73] Assignee: Power Alcohol, Inc., Hasbrouck Heights, N.J.

[21] Appl. No.: 774,071

[22] Filed: Jun. 28, 1985

[51] Int. Cl.[4] ..... C13K 1/02

[52] U.S. Cl. ..... 127/37; 127/1

[58] Field of Search ..... 127/37, 1

[56] References Cited

U.S. PATENT DOCUMENTS

| | | | |
|---|---|---|---|
| 4,018,620 | 4/1977 | Penque | 127/37 |
| 4,201,596 | 5/1980 | Church et al. | 127/37 |
| 4,242,455 | 12/1980 | Muller et al. | 435/162 |
| 4,291,124 | 9/1981 | Muller et al. | 435/162 |
| 4,316,747 | 2/1982 | Rugg et al. | 127/37 |
| 4,368,079 | 11/1983 | Rugg et al. | 127/1 |
| 4,409,032 | 10/1983 | Puszner et al. | 127/37 |
| 4,427,453 | 11/1984 | Reitter | 127/1 |
| 4,432,805 | 2/1984 | Nuuttila et al. | 127/37 |
| 4,452,640 | 6/1984 | Chen et al. | 127/37 |
| 4,468,256 | 8/1984 | Hinger | 127/1 |
| 4,478,644 | 10/1984 | Berger et al. | 127/1 |

FOREIGN PATENT DOCUMENTS

| | | | |
|---|---|---|---|
| 44622 | 1/1982 | European Pat. Off. | 127/37 |
| 91221 | 10/1983 | European Pat. Off. . | |
| 96497 | 12/1983 | European Pat. Off. . | |
| 1239529 | 7/1960 | France . | |
| 718174 | 11/1954 | United Kingdom . | |

OTHER PUBLICATIONS

*Chemical Abstract*, vol. 66 (1967), p. 9055, Abstract No. 963779, Tyshetskaya et al., "The Application of the Method of Salt (Extraction) Rectification to the Decomposition of HCl in the Production of Glucose by (Wood) Hydrolysis".

*Chemical Abstract*, vol. 100 (1984), p. 107, Abstract No. 105393a, Barker et al, "Solubilization and Hydrolysis of Cellulose Containing Materials".

*Primary Examiner*—Andrew H. Metz

*Assistant Examiner*—Chung K. Pak

*Attorney, Agent, or Firm*—Caesar, Rivise, Bernstein & Cohen, Ltd.

[57] ABSTRACT

A method of hydrolyzing cellulose to glucose and other saccharides, involving the bringing together in a reaction area an alphacellulose containing material, water, an effective amount of a calcium chloride catalyst and a minor amount of a hydrogen ion in a feedstock. The temperature of the feedstock is adjusted to between 150° C. to 250° C. at a pressure of at least 160 psig for a retention time of at least 20 seconds in the reaction area to convert the alphacellulose to said glucose and other saccharides.

3 Claims, No Drawings

METHODS OF HYDROLYZING CELLULOSE TO GLUCOSE AND OTHER (POLY)SACCHARIDES

BACKGROUND OF THE INVENTION

This invention relates to methods of hydrolyzing cellulose to glucose and other (poly)saccharides and is most particularly related to new and improved industrial processes of this general class. As used the term saccharides includes the various mono and (poly)saccharides that will readily occur to those skilled in the art, which are capable of being produced by the process of the present invention.

At the present time virtually all alcohol is made commercially by fermentation processes that involve the use of grain, starch or sugar obtained from cane, beet or fruit. Production of ethyl alcohol from such sources has been expensive in terms of both dollars and process requirements.

It has further been proposed in U.S. Pat. No. 4,018,620 the disclosure of column one, lines 8 to 61 of said patent being incorporated herein by reference, to hydrolyze cellulose to monosaccharides in a hydrolysis process. The hydrolysis process of U.S. Pat. No. 4,018,620 involves admixing cellulose, water, at least 5% $CaCl_2$ and about 0.01% to about 2% HCl, heating the reaction mixture to solubilize the cellulose until reducing sugars are formed from the solubilized cellulose.

It has been determined that the process of U.S. Pat. No. 4,018,620 results in a low yield and therefore is unsatisfactory for commercial purposes. While the abstract U.S. Pat. No. 4,018,620 mentions pressure and while said patent also in column 5, line 51 mentions "increased pressures", there is nothing in U.S. Pat. No. 4,018,620 to teach which particular increased pressures were contemplated. Also the lengthy reaction times of U.S. Pat. No. 4,018,620 strongly favor the formation of unwanted by-products.

Accordingly, it is an object of the present invention to provide methods of hydrolyzing cellulose to glucose and other (poly)saccharides which achieve a relatively high yield to produce preferably glucose under commercially acceptable conditions of great economy.

The present invention involves the bringing together of a cellulose containing material or materials, water, a $CaCl_2$ catalyst and a minor amount of HCl or other acid under the prescribed conditions of temperature, pressure and retention time to achieve significantly higher yields in converting cellulose to glucose.

In the preferred method it is possible to use a wide variety of alphacellulose containing materials. These materials can be provided in various forms, such as, sawdust, wastepaper, corn stover, cattails, confetti, newsprint, wheat straw and brewer's dried grain.

The $CaCl_2$ catalyst is preferably present on a total solids basis (including the alphacellulose containing feedstock) in an amount of approximately 20% by weight and possibly up to 27½%. The HCl or other acid is present on a total mass solids basis in an amount of from 0.025% to 0.05%. Actually, the $CaCl_2$ catalyst is introduced into the system in an aqueous solution at a concentration as high as 55% by weight as will be discussed hereinafter. In such an aqueous solution, the HCl or other acid will not exceed 0.5% by weight of the aqueous solution. However, in the preferred mode, the acid component will not be lower than 0.01%.

Although the mechanism of the present hydrolysis reaction has not been definitely ascertained, it is believed that the HCl or other acid increases ionization, and in this way acts as a triggering agent to prompt the hydrolysis reaction.

Also, the setting of a particular pressure facilitates the holding of the temperature in the range of 150° C. to 250° C., with the preferred range being from 175° C. to 195° C. The precise temperature or temperature range within the above-stated ranges will vary depending upon the alphacellulose composition of the feedstock. For instance cattails are believed to require a higher temperature in these ranges. At temperatures significantly below 175° C., the reaction proceeds extremely slowly. The upper limit of the temperature is set at 195° C. since operation at temperatures significantly beyond 195° C. will cause burning and create unwanted degradation products. Since the present hydrolysis reaction is exothermic, such evolution of heat must be taken into account in holding the temperature in the 175° C. to 195° C. range.

Also, pressure is quite important for the successful carrying out of the present invention. It has been determined that the pressure should be at least 160 psig. Present testing has shown successful carrying out the present invention at pressures as high as 800 psig, although there is no intention to place an upper limit on the pressure. Of course, from a financial or cost standpoint there is a practical upper limit to pressure beyond 800 psig.

It is believed that pressure is important to achieve good physical contact between the $CaCl_2$ catalyst and the cellulose molecules. Indeed, it is believed that pressure significantly above 160 psig, but usually less than 800 psig is necessary to obtain rapid penetration of the catalyst into the cellulose containing materials.

The $CaCl_2$ catalyst is preferably present in an amount which is close to the maximum saturation of $CaCl_2$ in an aqueous solution at 100° C., which is a 55% aqueous solution. Since approximately 50% of the total weight involved in the process of the present invention is the cellulose containing material or materials and the balance is basically the catalyst solution, this means that the maximum theoretical percentage of $CaCl_2$ on a total solids basis will be approximately 27½%. As a practical matter the process of the present invention proceeds with a percentage of $CaCl_2$ between 20 and 27½% with 25% being the practical upper limit of $CaCl_2$ which may be present in amounts as low as 5% although greater amounts are preferred.

The data obtained from batch trials are approximate, but seem to follow first order kinetics. For this reaction the overall rate constant was determined to be 0.90. The data obtained deviate from straight cellulose acid hydrolysis.

Based upon the data obtained, a graph of percent sugar versus reaction time was made for several better test runs. The apprpoximate energy of activation based upon these data is 7,526 cals. It has been determined that the rate constant for converting alphacellulose to glucose in the present invention is about 0.0611 reciprocal minutes. Also, the heat of reaction for the hydrolysis conversion process of the present invention is minus 12.99 kilojoules per mole of cellulose since the hydrolysis process is exothermic.

Upon further process refinement, the aforesaid numbers may change.

Another important feature of the invention is that the retention time in the reaction area preferably does not exceed 20 seconds and is usually more than 10 seconds, although shorter times are contemplated. Beyond this time period secondary reactions set in to produce increasingly greater amounts of unwanted by-products, such as furfural, hydromethylfurfural, acetic acid, formic acid, levulinic acid, nonenzymatic browning and/or Maillard products. However the present invention does contemplate retention times, somewhat in excess of 20 seconds and up to 1 minute and possibly longer, provided there is a minimal acceptable production of unwanted by-products.

As will be discussed in one of the example to be presented, the present invention is preferably carried out on a continuous basis, although other techniques such as batch processing are contemplated.

After the reaction occurred in the reaction area to hydrolize the cellulose to glucose and other (poly)saccharides, the temperature of the products of the reaction are immediately lowered in the next section of the continuous system to less than 100° C. in a very short period of time, preferably no longer than 1 second. This can be achieved by exposure of the reaction products to atmospheric pressure in a spray step which brings about a significant and sudden lowering of pressure which in turn lowers the temperature. It is important that the temperature of the reaction products be preferably cooled below 85° C. to avoid degredation of the glucose. The addition of cooling water is contemplated to achieve the desired temperature of the reaction products.

The actual water content of the feedstock to the reaction area comes from several sources. First, the cellulose containing material has a considerable amount of physically or chemically bound water content that can be as high as 50%. For instance, dry newsprint is perhaps the lowest in bound water content, usually containing about 9% moisture. On the other hand corn stover will be quite high in the area of approximately 50% moisture content. Sawdust is a bit lower at 40%.

There is also water present in the $CaCl_2$ solution as well as in the HCl solution that is added to the $CaCl_2$ solution. Finally, where dry steam is used there will be an additional source of water. All four sources of water must be taken into account and calculated to determine the total amount of water present.

As previously stated it is preferred that the process of the present invention be carried out on a continuous basis. Very little preparation is required with reference to the cellulose containing material. Depending upon the nature of the particular alphacellulose containing material, some preparation may be necessary, such as rough shredding.

There are two forms of cellulose. One form is the alphacellulose form and the other form is the hemicellulose form. For carrying out the present invention the alphacellulose form is much preferred since under the hydrolysis reaction, alphacellulose will convert to glucose. On the other hand hemicellulose will convert mainly to pentose. Accordingly, it is preferred that the hemicellulose be removed in a preparatory step in accordance with procedures well known to those skilled in the art.

Continuous extrusion-type pipe reactors are used in the present invention for converting cellulose to glucose. These reactors are widely used in the pharmaceutical and plastics industries. The capacities and temperature-pressure ranges needed for practice of the prsent invention, are readily available.

The chemical reaction imposed by the process of the present invention, involves the breaking of the extremely long-chain cellulose molecule into individual glucose molecules. This is done by hydrolysis of the carbon-oxygen-carbon link between individual glucoside units that make up cellulose.

The hydrolysis reaction of the present invention is quite rapid, with reaction time being preferably no greater than 20 seconds. However, the reaction of the present invention is also very gentle in that it hydrolizes cellulose without producing significant organic char.

In the practice of the present invention on a continuous basis, a water slurry of fibers is formed and is fed to a screw press for partial dewatering. The $CaCl_2$ and HCl solution are brought together and then steam is then injected into the partially dewatered slurry to achieve a desired temperature rise. Moreover, the mechanical working of the screw feeding mechanism used in the present invention adds further heat and pressure to the system. It is contemplated that most, if not all of the pressure build-up will be accomplished by the mechanical action of the screw feeding mechanism. Thus, at this point the only cellulose component of the feedstock will be alphacellulose.

The reaction mixture then proceeds to a point where the aqueous solutions of $CaCl_2$ and HCl come together (either individually or premixed), with dry steam (if necessary) being injected into the feedstock which is then fed to the principal reaction area of the system while being subjected to increasing temperature and pressure. Thus, when the reaction mixture reaches the reaction area of the system, the temperature is in the range of 175° C. to 195° C. and the pressure is in the range of 160 psig to 800 psig.

The reaction proceeds for 20 seconds and the reaction products are then immediately discharged into atmospheric pressure in a spraying action to achieve a lowering of temperature to approximately 85° C. in about 1 second. Where necessary, cooling water may be added. The glucose recovery process then begins.

The glucose recovery is effected through the use of ion exchange resin beads in a manner well known to those skilled in the art. The hot syrup from the continuous reactors flows under pressure from the screw press to flash tanks positioned over resin beds. The syrup is collected by spraying it over drums into which return flow catalyst is sprayed. A small quantity of cold water also is injected into the flash tanks. Heat given up by the incoming syrup helps reconstitute the recovered $CaCl_2$ catalyst by evaporating water from it. The recovered $CaCl_2$ solution is reconcentrated by spraying against a concentrator-cooler and then returned to the supply tanks.

The glucose recovery system utilizes a series of ion exclusion resin exchanges. These are similar in design and size to industrial water softeners. As the syrup flows through the exchanges, the non-ionic sugar molecules are captured by the resin beads. The ionic $CaCl_2$ catalyst and HCl molecules pass through unaffected and are returned through the cooler-concentrators to the catalyst feed system.

Glucose and other reducing sugars captured by the resin beads are recovered by flushing the beads with water. The concentration of glucose and other reducing sugars in the cold syrup produced by flushing is controlled by the rate of water flow. The concentration can be as high as the maximum solubility of glucose water. Thus, the glucose recovery system also serves as a glucose concentrator.

The concentrated glucose solution may then be fermented to alcohol in accordance with processes well known to those skilled in the art.

The process of the present invention is expected to yield significant quantities of valuable by-products. Such by-products will include pentose sugars, mainly xylose. The source of this pentose will be almost entirely from hemicellulose which is present when newsprint, wood, straw, cane and gin trash are used. These pentose sugars are mainly the product of the hemicellulose which is removed prior to the reaction area of the continuous system.

Another valuable by-product is lignin. It has been found that when lignin is present in the feed stock, it will extrude from the reaction area in almost pure form. There are also naval stores that distill off at reaction temperatures. Separate condensation temperatures will improve efficiency of collection.

Other valuable by-products will be carbonates, ammonium chloride and yeast protein.

EXAMPLE I

Continuous

In a hydrolysis reaction in accordance with the present invention, carried out on a continuous basis, the total dry solids concentration of sawdust was 47.8% by weight of the total feed stock. The $CaCl_2$ catalyst was present on a total solids basis of 9.9%. In the reaction area the temperature was 380° F. and the pressure was 180 psig. The retention time was 11 seconds. The feedstock to the reaction area had the following composition:

| | | |
|---|---|---|
| Wood (dry basis) | | 47.658% |
| Alphacellulose | 24.08% | |
| Hemicellulose | 8.03% | |
| Lignin | 11.08% | |
| Extract (approx.) | 4.468% | |
| Calcium chloride | | 9.9% |
| Water | | 42.4% |
| HCl | | 0.042% |

The yield was 77% and was determined in accordance with a glucose determination pretreatment procedure using high pressure liquid chromotography (HPLC). Another established glucose determination technique is known as the Fehling method which was also used to make basic confirmation of the very high yields indicated by HPLC.

EXAMPLE II

Batch

Scott's toilet paper was used as the main raw material for testing, because of its known composition:

| | |
|---|---|
| Cellulose | 75% |
| Hemicellulose | 10% |
| Lignin/impurities | 10% |
| Moisture | 5% |
| | 100% |

Reactant mixtures: toilet paper at 10 to 12% (w/w) solids plus hydrochloric acid at approximately 0.25% total mass and saturated calcium chloride at a specific gravity of 1.59 at 120° C.

Because of the direct steam injection there was a considerable dilution effect.

Agitator energy input into reactant mixtures approximately 66 Btu during the sampling period of 90 seconds.

Glucose (reducing sugar) determination of about 4% was by the Fehling method. This value of approximately 4% should be corrected to take the dilution effect into account.

EXAMPLE III

Batch

| | |
|---|---|
| Toilet paper | 1895 g |
| Hydrochloric acid | 97 g |
| Calciumchloride sat'd. soln. | 10008 g |
| | 12000 g |

Maximum reducing sugar concentration obtained: 4.07%. This is a net sugar yield of 52.7% and since the conversion was essentially complete, the rest degraded to furfural and other decomposition products.

The reaction was exothermic. Maximum steam temperature was 376° F., while the reactant temperature very rapidly increased to 418° F. Assuming a specific heat of 1.0 Btu/(lb)(F) for the diluted reaction mixture, and neglecting heat losses through conduction and radiation, the HEAT OF REACTION=1.2 Btu/gram of cellulose.

Time to reach the maximum sugar yield was 50 seconds. When the temperature reached 350° F. the reaction was considered to take off and the reaction time was recorded for the samples taken. The samples were run into Erlenmeyer flasks containing dry ice, so as to arrest the reactions!

From all of the foregoing it can be seen that the present invention provides methods of hydrolyzing cellulose to glucose and other polysaccharides and that such methods achieve a significant yield, producing mainly glucose under commercially acceptable conditions of great economy. In accordance with the method of the present invention the feedstock temperature, reaction area pressure and reaction retention time are controlled within specified limits in order to achieve the beneficial results of the present invention.

Without further elaboration, the foregoing will so fully illustrate my invention that others may, by applying current or future knowledge, readily adopt the same for use under various conditions of service.

I claim:

1. A method of hydrolizing cellulose to glucose and other saccharides, said method comprising bringing to a reaction area a feed mixture consisting essentially of at least one alphacellulose containing material, water, a calcium chloride catalyst present in an amount of from 5 to 27.5% by weight on a total solids basis, said calcium chloride catalyst being in an aqueous solution, and a minor amount of hydrochloric acid (HCl), said HCl being present in amount ranging from approximately 0.01 to 0.5% by weight of said calcium chloride catalyst aqueous solution, adjusting the temperature of said feed mixture to between 150° C. to 250° C., at a pressure of from 160 psig to 800 psig, for a finite retention time of up to one minute in the reaction area to convert the alphacellulose containing material to said glucose and other saccharides.

2. The process of claim 1 wherein said retention time does not exceed 20 seconds.

3. The process of claim 1 wherein said calcium chloride catalyst is present in an amount of about 20% by weight on said total solids basis.

* * * * *